US012055157B1

(12) United States Patent
Lin et al.

(10) Patent No.: US 12,055,157 B1
(45) Date of Patent: Aug. 6, 2024

(54) CENTRIFUGAL FAN

(71) Applicant: ASUSTEK COMPUTER INC., Taipei (TW)

(72) Inventors: Hsin Chen Lin, Taipei (TW); Ing-Jer Chiou, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 18/333,325

(22) Filed: Jun. 12, 2023

(30) Foreign Application Priority Data

Mar. 2, 2023 (TW) ..... 112107634

(51) Int. Cl.
*F04D 29/28* (2006.01)
*F04D 17/08* (2006.01)
*F04D 29/42* (2006.01)

(52) U.S. Cl.
CPC ..... *F04D 29/281* (2013.01); *F04D 17/08* (2013.01); *F04D 29/4226* (2013.01)

(58) Field of Classification Search
CPC ..... F04D 29/281; F04D 29/282; F04D 17/08
See application file for complete search history.

(56) References Cited

U.S. PATENT DOCUMENTS 9,995,304 B2 * 6/2018 Lin ..... F04D 29/281
2005/0249604 A1 11/2005 Wu et al.

FOREIGN PATENT DOCUMENTS

| | | | |
|---|---|---|---|
| CN | 202125460 | U | 1/2012 |
| CN | 212003723 | U | 11/2020 |
| TW | I476327 | B | 3/2015 |
| TW | 201640026 | A | 11/2016 |

* cited by examiner

*Primary Examiner* — Sabbir Hasan
(74) *Attorney, Agent, or Firm* — Muncy, Geissler, Olds & Lowe, P.C.

(57) ABSTRACT

A centrifugal fan includes upper and lower covers, a fan frame, and a fan blade module. The fan frame is located between the lower and upper covers. The fan frame, and the lower and upper covers form a space. The fan blade module disposed in the space includes a hub, a connecting ring, inner and outer ring blades. The connecting ring surrounding the hub forms an inner ring region and an outer ring region around the hub and has a ring height and a ring width greater than the ring height. The inner ring blades are connected to the hub and the connecting ring, and circularly arranged in the inner ring region. The outer ring blades are connected to the connecting ring, and circularly arranged in the outer ring region. A quantity of the outer ring blades is greater than a quantity of the inner ring blades.

9 Claims, 14 Drawing Sheets

CENTRIFUGAL FAN

CROSS-REFERENCE TO RELATED APPLICATION

This application claims the priority benefit of Taiwan application serial No. 112107634, filed on Mar. 2, 2023. The entirety of the above-mentioned patent application is hereby incorporated by reference herein and made a part of the specification.

BACKGROUND OF THE INVENTION

Field of the Invention

This disclosure relates to a fan, and in particular, to a centrifugal fan for cooling an electronic device.

Description of the Related Art

A centrifugal fan includes a plurality of blades circularly arranged on the periphery of a central hub, and as the blades rotate, the airflow is inhaled into the space between the blades along the axial direction of the central hub, and then discharged outward along the centrifugal direction in which the blades rotate.

Generally, fan performance is improved by increasing the quantity of blades. However, the thickness of the blade and the spacing between the inner diameter positions of the blades are limited by manufacturing capability and structural strength, and it is impossible to freely increase the quantity of blades. In addition, the spacing between adjacent blades is not excessively narrow in practical design. The excessively narrow spacing affects airflow circulation and degrades the fan performance.

BRIEF SUMMARY OF THE INVENTION

This disclosure provides a centrifugal fan. This centrifugal fan includes an upper cover, a lower cover, a fan frame, and a fan blade module. The fan frame is located between the lower cover and the upper cover, and the fan frame, the lower cover, and the upper cover form a space. The fan blade module is disposed in the space and comprises a hub, a connecting ring, a plurality of inner ring blades, and a plurality of outer ring blades. The connecting ring surrounds the hub and forms an inner ring region and an outer ring region around the hub. The connecting ring has a ring height and a ring width, and the ring width is greater than the ring height. The plurality of inner ring blades is connected to the hub and the connecting ring, and circularly arranged in the inner ring region. The plurality of outer ring blades is connected to the connecting ring, and circularly arranged in the outer ring region. A quantity of the outer ring blades is greater than a quantity of the inner ring blades.

The fan blade module of the centrifugal fan provided in this disclosure includes the inner ring blades, the connecting ring, and the outer ring blades. The outer ring blades extend outward from the connecting ring, and a diameter of the connecting ring is greater than a diameter of the hub. Therefore, under the limitation of the same manufacturing capability, more blades are arranged in the centrifugal fan provided in this disclosure than the conventional centrifugal fan, to improve fan performance.

DETAILED DESCRIPTION OF THE EMBODIMENTS

Specific implementations of this disclosure are further described in detail below with reference to the accompanying drawings. According to the following descriptions and claims, the advantages and features of this disclosure are clearer. It should be noted that the drawings are drawn by using an extremely simplified form and imprecise proportion, which are only used for conveniently and clearly assisting in explaining the objective of the embodiments of this disclosure.

Figure 1:
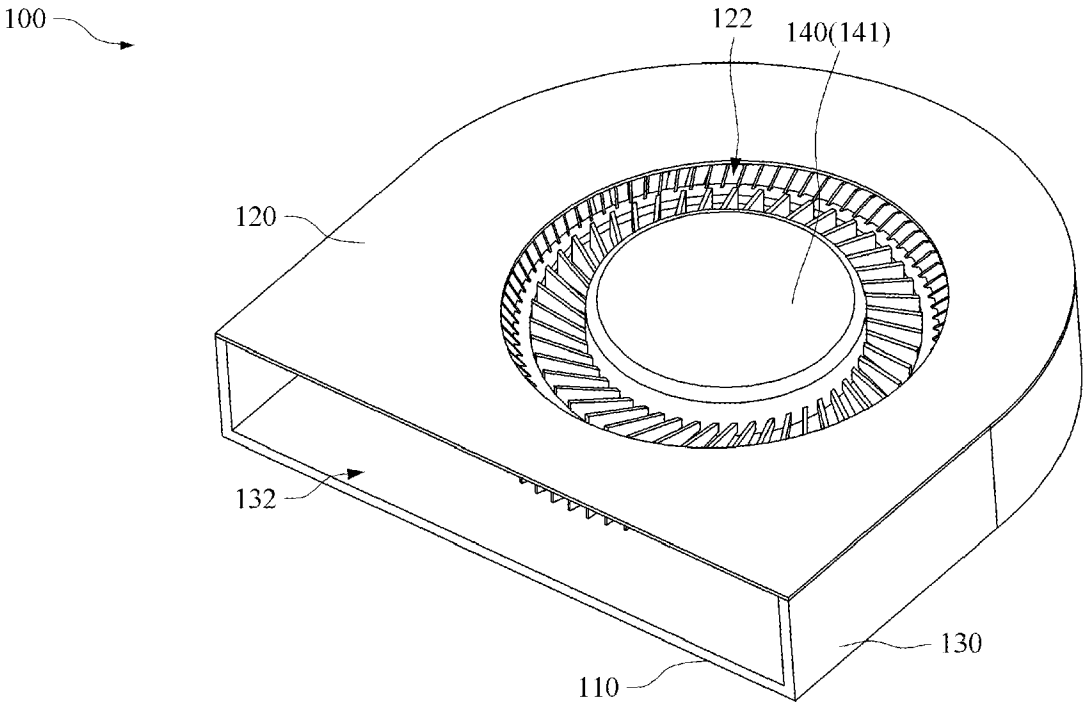
FIG. 1 is a schematic three-dimensional view of a centrifugal fan according to an embodiment of this disclosure.
Figure 2:
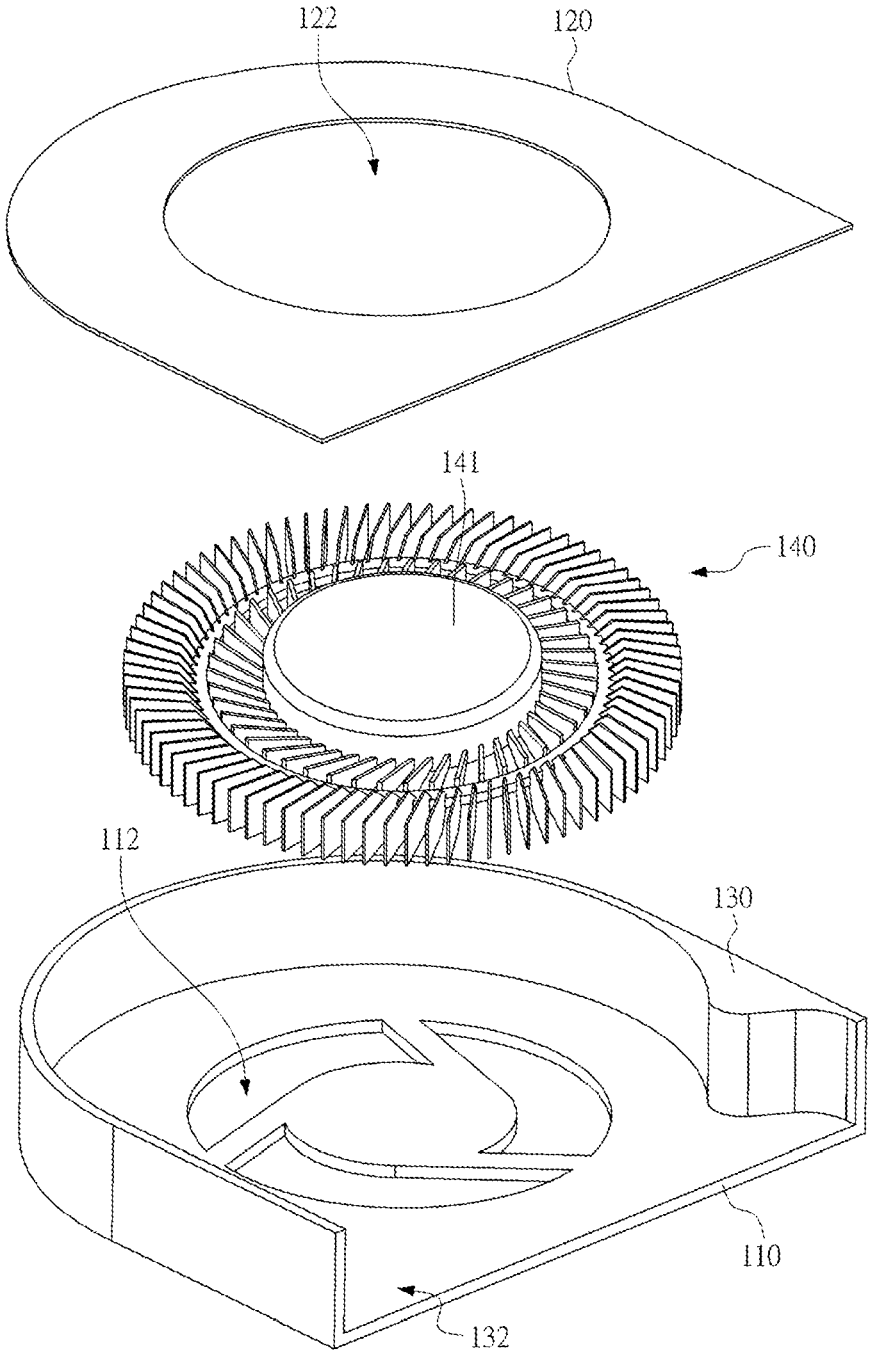
FIG. 2 is a schematic exploded view of the centrifugal fan in FIG. 1.

FIG. 1 is a schematic three-dimensional view of a centrifugal fan 100 according to an embodiment of this disclosure. FIG. 2 is a schematic exploded view of the centrifugal fan 100 in FIG. 1.

As shown in the figure, the centrifugal fan 100 includes a lower cover 110, an upper cover 120, a fan frame 130 and a fan blade module 140.

The lower cover 110 includes a lower air inlet 112, and the upper cover 120 includes an upper air inlet 122. The fan frame 130 is located in a space formed between the lower cover 110 and the upper cover 120, and one side of the fan frame 130 has an air outlet 132. The fan blade module 140 is disposed in the space.

Figure 3:
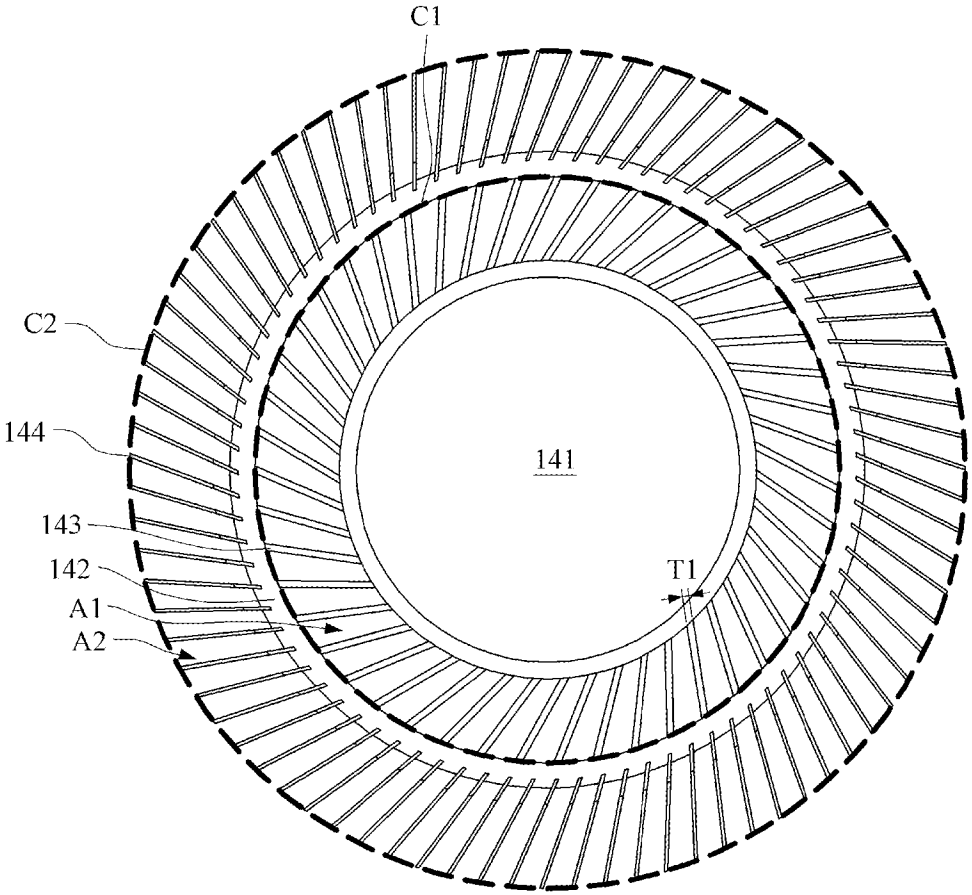
FIG. 3 is a schematic top view of a fan blade module in FIG. 2.

Referring to FIG. 3 together, FIG. 3 is a schematic top view of the fan blade module 140 in FIG. 2.

As shown in the figure, the fan blade module 140 includes a hub 141, a connecting ring 142, a plurality of inner ring blades 143, and a plurality of outer ring blades 144.

The connecting ring 142 surrounds the hub 141 and forms an inner ring region A1 and an outer ring region A2 around the hub 141. The inner ring blades 143 are circularly arranged in the inner ring region A1, and the outer ring blades are circularly arranged in the outer ring region A2.

The inner ring blades 143 extend from the hub 141 toward a direction of the connecting ring 142 and are connected to the connecting ring 142. The outer ring blades 144 extend outward from the connecting ring 142, that is, extend from the connecting ring 142 toward a direction away from the inner ring blades 143.

Generally, the inner ring blades 143 extend outward from the hub 141, the outer ring blades 144 extend outward from the connecting ring 142, and a diameter of the connecting ring 142 is obviously greater than a diameter of the hub. Therefore, under the limitation of the same manufacturing capability, a quantity of the outer ring blades 144 is greater than a quantity of the inner ring blades 143.

Figure 4:
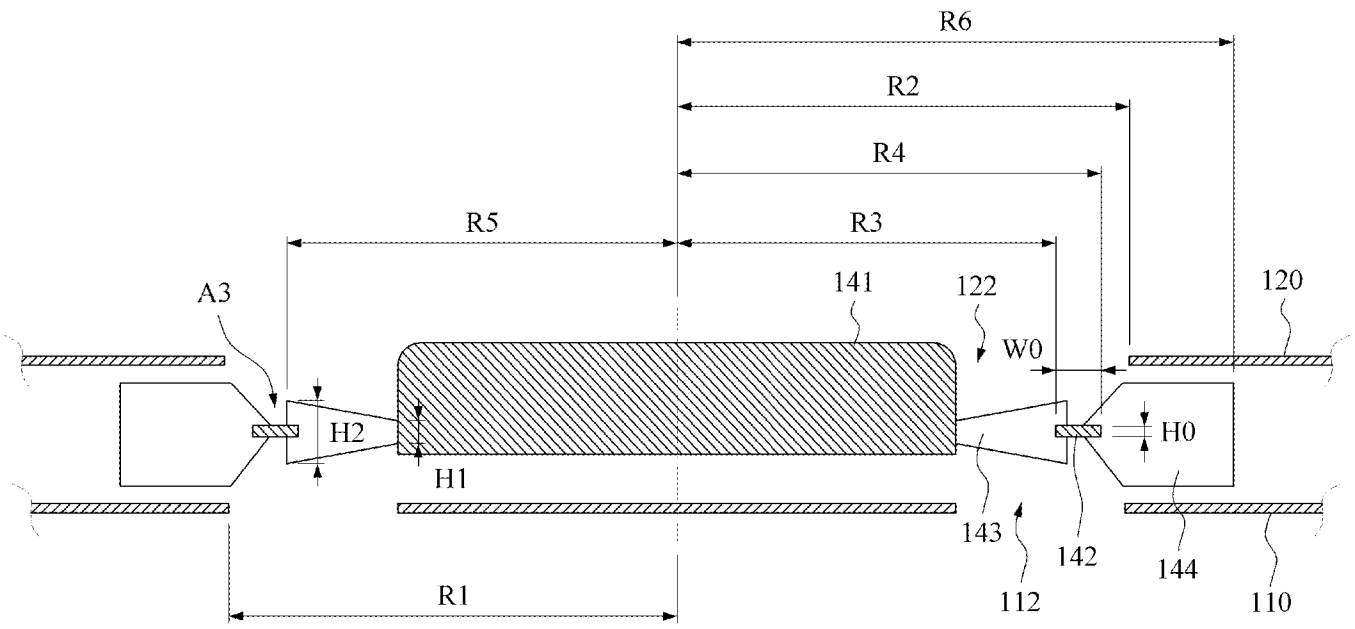
FIG. 4 is a schematic cross-sectional view of the centrifugal fan in FIG. 1.

Referring to FIG. 3 and FIG. 4 together, FIG. 4 is a schematic cross-sectional view of the centrifugal fan 100 in FIG. 1.

As shown in the figure, the lower air inlet 112 has a lower air inlet radius R1, and the upper air inlet 122 has an upper air inlet radius R2. One side of the connecting ring 142 facing the hub 141 has an inside radius R3, and one side of the connecting ring 142 away from the hub 141 has an outside radius R4. The connecting ring 142 has a ring height H0 and a ring width W0. The ring width W0 is a difference between the outside radius R4 and the inside radius R3, and the ring width W0 is greater than the ring height H0. A surrounding range of the plurality of inner ring blades 143 defines an inner circle C1, and the inner circle C1 has an inner circle radius R5. A surrounding range of the plurality of outer ring blades 144 defines an outer circle C2, and the outer circle C2 has an outer circle radius R6.

The inner circle radius R5 is greater than the inside radius R3, and the inner circle radius R5 is less than the outside radius R4, to ensure that the inner ring blades 143 effectively supports the connecting ring 142. The outer circle radius R6 is greater than the outside radius R4, and the outside radius R4 is less than the lower air inlet radius R1 or the upper air inlet radius R2, to ensure that inlet airflows from the lower air inlet 112 and the upper air inlet 122 effectively flow to the outer ring blades 144.

In an embodiment, the outside radius R4 is less than or equal to 85% of the outer circle radius R6 to ensure that each outer ring blade 144 has a sufficient sweeping area. In an embodiment, the inside radius R3 is greater than or equal to 60% of the outer circle radius R6 to ensure that sufficient outer ring blades 144 are disposed on the connecting ring 142 to improve the efficiency of the centrifugal fan 100.

Since the flow velocity of the inlet airflow close to an edge of the lower air inlet 112 or the upper air inlet 122 (that is, far from a rotation axis of the fan blade module 140) is high, in an embodiment, as shown in the figure, a connection position of the outer ring blade 144 and the connecting ring 142 is outside a connection position of the inner ring blade 143 and the connecting ring 142 without overlapping, and an airflow space A3 is formed between the inner ring blade 143 and the outer ring blade 144. The position of the airflow space A3 corresponds to the edge of the lower air inlet 112 or the upper air inlet 122, so that the inlet airflows flow to the center of the outer ring blade 144 without hindrance, to improve the efficiency of the centrifugal fan.

In addition, referring to FIG. 3 and FIG. 4 together, in an embodiment, as shown in the figure, an inside height H1 of the inner ring blade 143 is less than its outside height (that is, a blade height H2), so that the inner ring blade 143 presents a ladder structure that expands outward. The outside height H2 is the blade height of the inner ring blade 143. In an embodiment, the blade height H2 of the inner ring blade 143 is three times greater than a blade thickness T1 of the inner ring blade 143, and the inner ring blade 143 is located within a range formed by a lower surface of the lower cover 110 and an upper surface of the upper cover 120, to ensure that the inner ring blades 143 provide an effective flow guiding effect, to guide the inlet airflows flowing into the inner ring region A1 to the outer ring blades 144.

The inner ring blades 143 in FIG. 4 are in a vertically symmetrical structure to match the inlet airflows from the lower air inlet 112 and the upper air inlet 122.

Figure 5A:
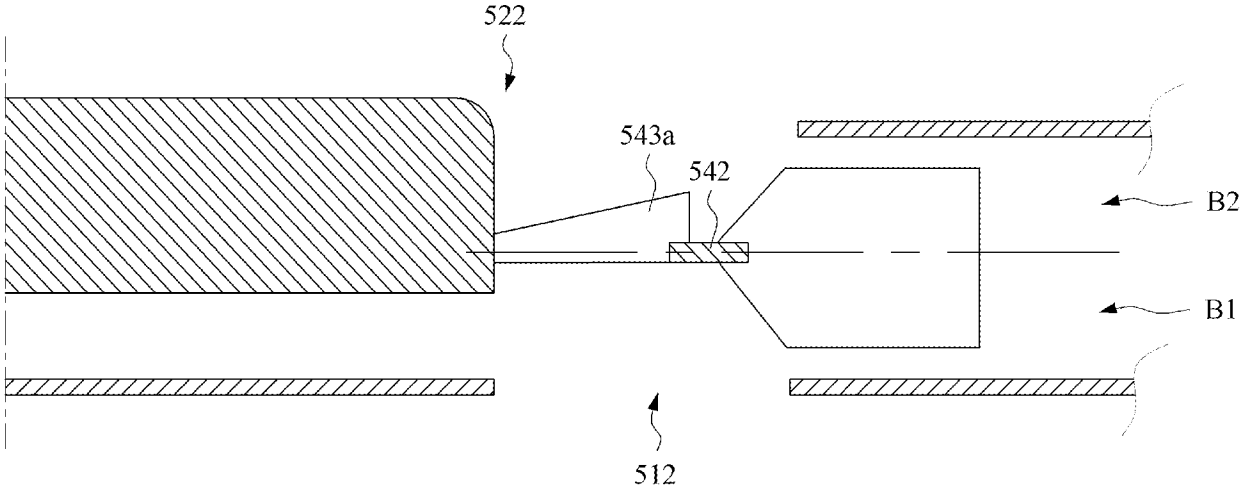
FIG. 5A to FIG. 5C show three different embodiments of an inner ring blade of this disclosure.
Figure 5B:
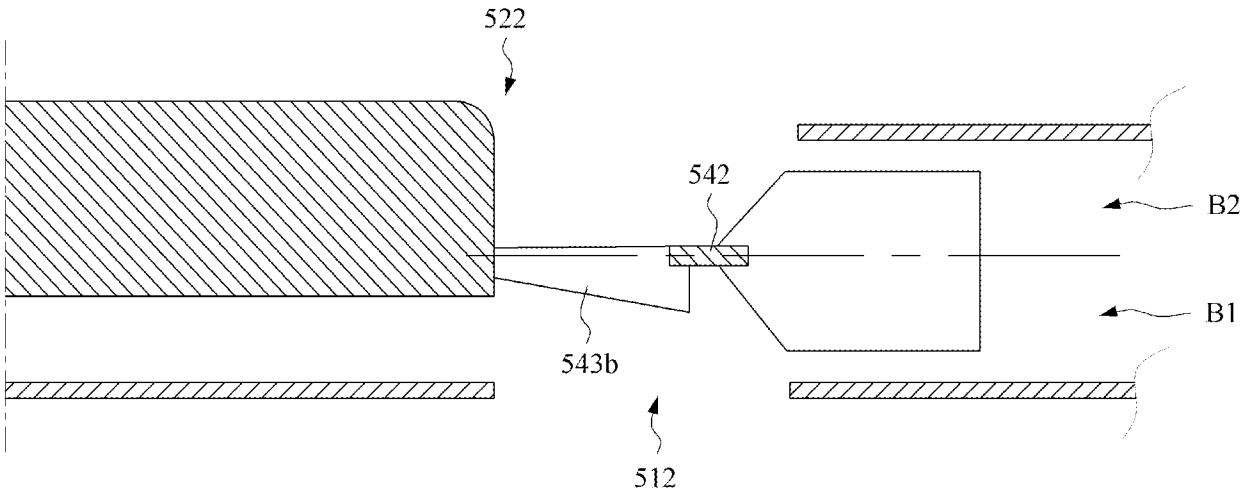
Figure 5C:
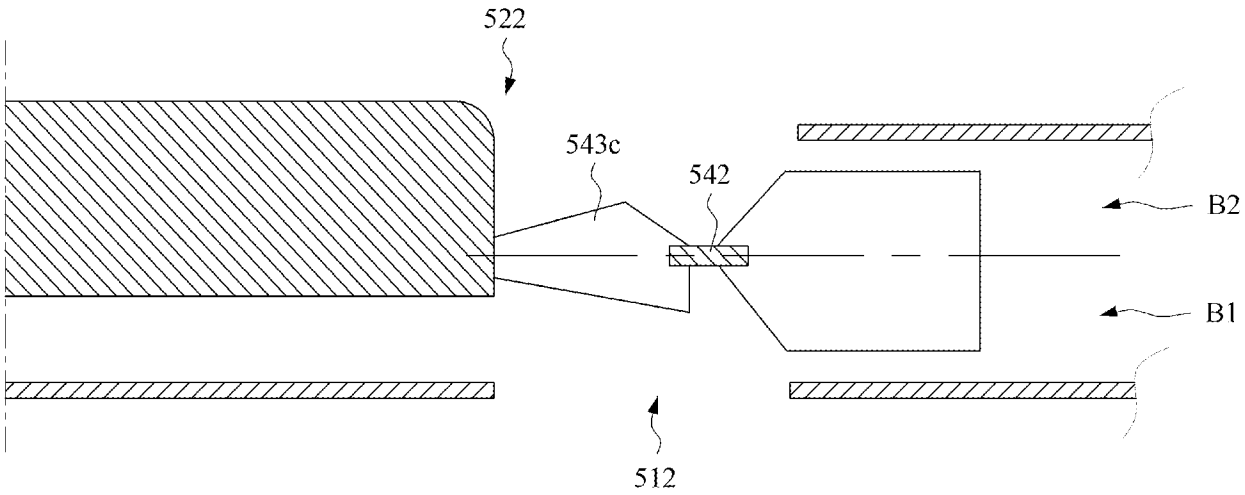

Referring to FIG. 5A to FIG. 5C together, FIG. 5A to FIG. 5C show three different embodiments of the inner ring blade of this disclosure.

With the position of the connecting ring 542 as the boundary, an inner space of the centrifugal fan is divided into a lower part B1 close to the lower cover and an upper part B2 close to the upper cover.

In the embodiment shown in FIG. 5A, an inner ring blade 543*a* is approximately located in the upper part B2. This embodiment is applicable to a situation in which the inlet airflows mainly come from the upper air inlet 522. In the embodiment shown in FIG. 5B, an inner ring blade 543*b* is approximately located in the lower part B1. This embodiment is applicable to a situation in which the inlet airflows mainly come from the lower air inlet 512. In the embodiment shown in FIG. 5C, an inner ring blade 543*c* is located at both the lower part B1 and the upper part B2. However, unlike the embodiment in FIG. 4, the inner ring blade 543*c* of this embodiment is not vertically symmetrical. This embodiment is applicable to a situation in which the inlet airflows come from the upper air inlet 522 and the lower air inlet 512, but the configurations of the upper air inlet 522 and the lower air inlet 512 are different.

A radial cross section of the connecting ring 142 in FIG. 4 presents a rectangle to reduce manufacturing costs.

Referring to FIG. 6A to FIG. 6G together, FIG. 6A to FIG. 6G show seven different embodiments of the connecting ring of this disclosure. The connecting ring is shown by a radial cross-sectional view in the figures.

Figure 6A:
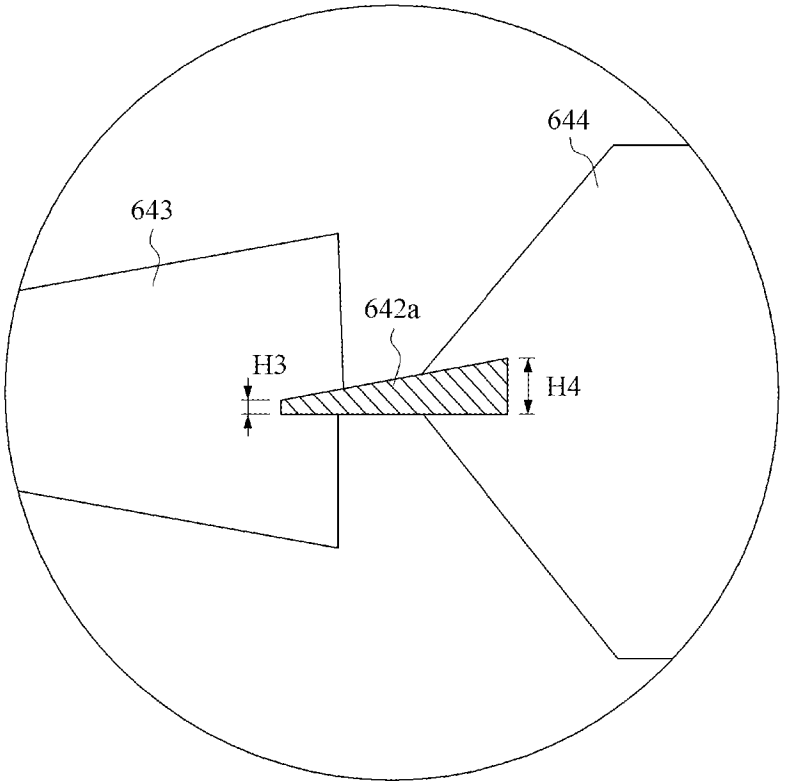
FIG. 6A to FIG. 6G show seven different embodiments of the connecting ring of this disclosure.

In the embodiment shown in FIG. 6A, one side of a connecting ring 642*a* facing the hub (not shown in the figure) has an inside ring height H3, one side of the connecting ring 642*a* away from the hub (not shown in the figure) has an outside ring height H4, and the inside ring height H3 is less than the outside ring height H4, so that a radial cross section of the connecting ring 642*a* presents a trapezoid. In addition, a connection position of the connecting ring 642*a* and an inner ring blade 643 is below a connection position of the connecting ring 642*a* and an outer ring blade 644.

Figure 6B:
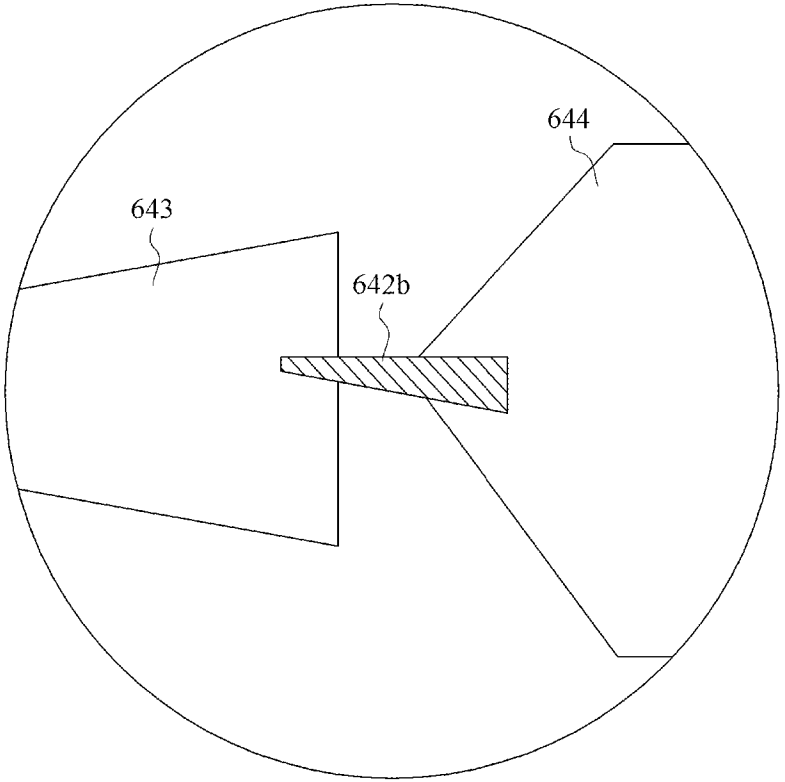

The embodiment shown in FIG. 6B is similar to the embodiment shown in FIG. 6A, and a radial cross section of the connecting ring 642*b* also presents a trapezoid. However, a connection position of the connecting ring 642*b* and the inner ring blade 643 is above a connection position of the connecting ring 642*b* and the outer ring blade 644.

Figure 6C:
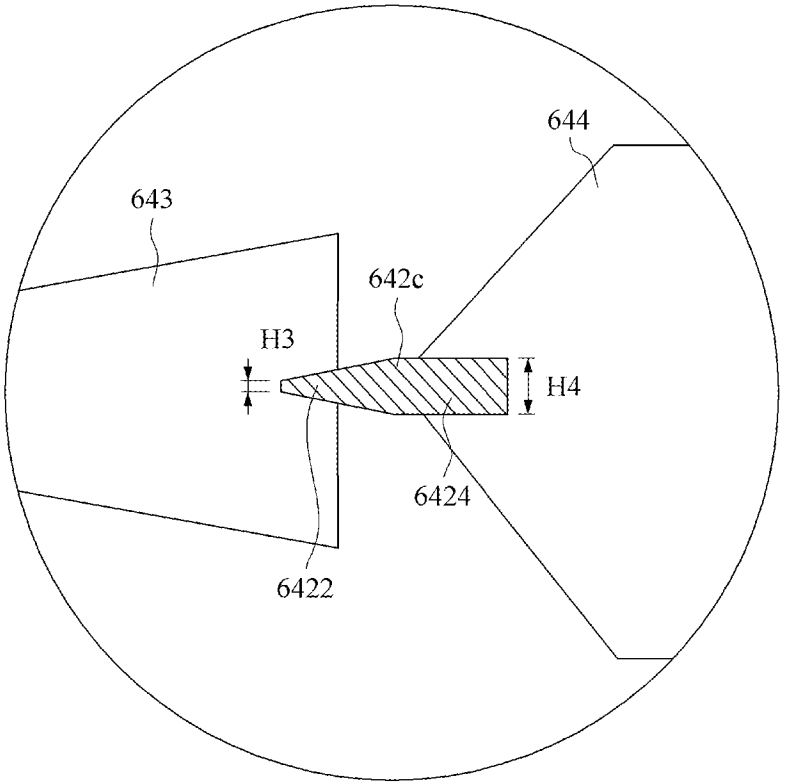

In the embodiment shown in FIG. 6C, a radial cross section of a connecting ring 642*c* presents a vertically symmetrical structure, and the connecting ring 642*c* is divided into an inclined portion 6422 on the inner side and a horizontal portion 6424 on the outer side. An inside ring height H3 of one side of the connecting ring 642*c* facing the hub (not shown in the figure) is also less than an outside ring height H4 of one side of the connecting ring 642*c* away from the hub (not shown in the figure).

Figure 6D:
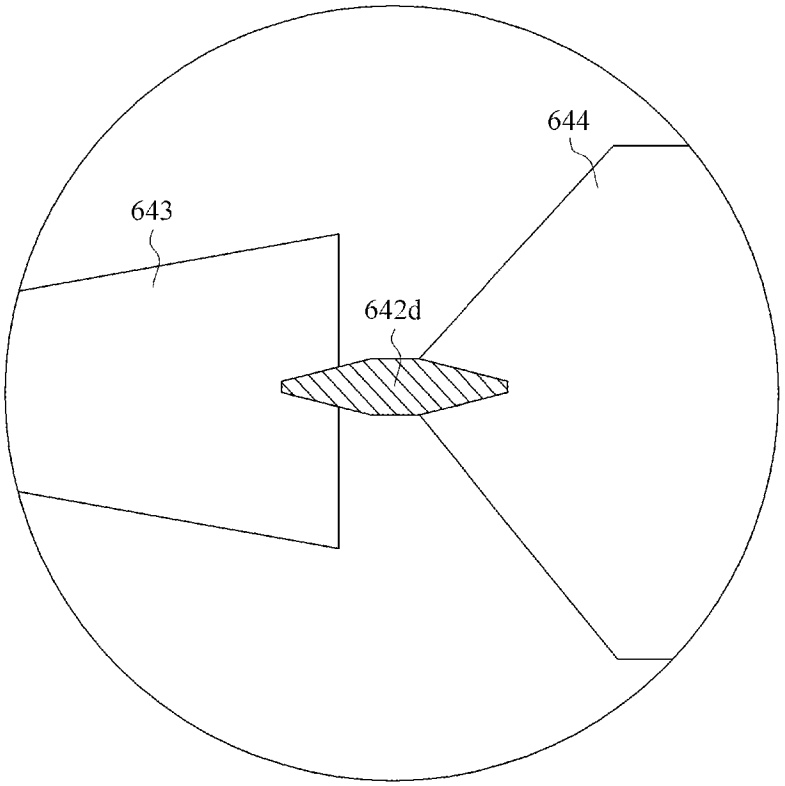

In the embodiment shown in FIG. 6D, a radial cross section of a connecting ring 642*d* presents a horizontally symmetrical structure, which is similar to an eye shape or a drop shape.

Figure 6E:
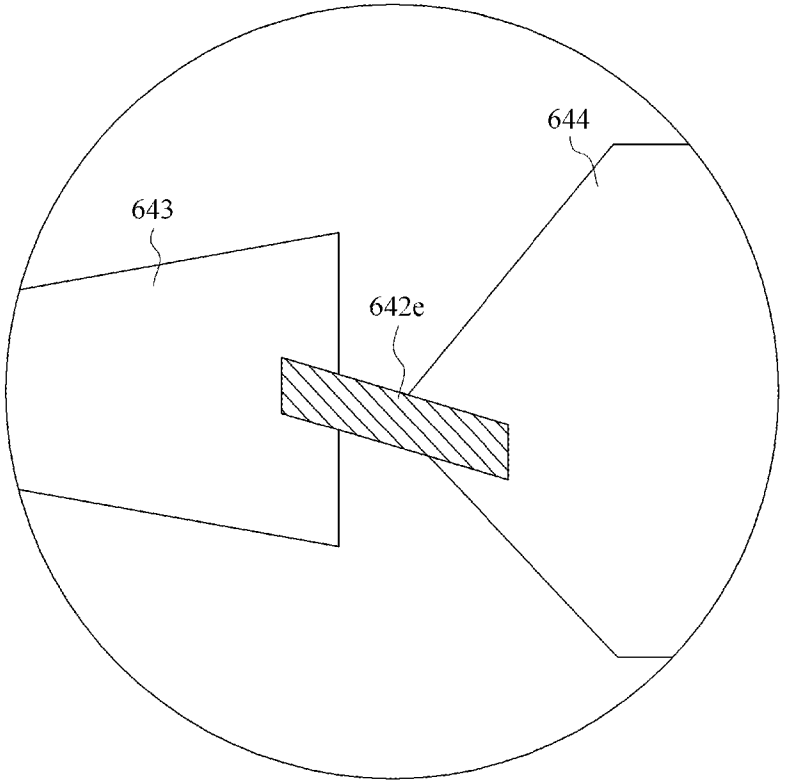

In the embodiment shown in FIG. 6E, a radial cross section of a connecting ring 642*e* presents a parallelogram, and a connecting position of the connecting ring 642*e* and the inner ring blade 643 is above a connecting position of the connecting ring 642*e* and the outer ring blade 644.

Figure 6F:
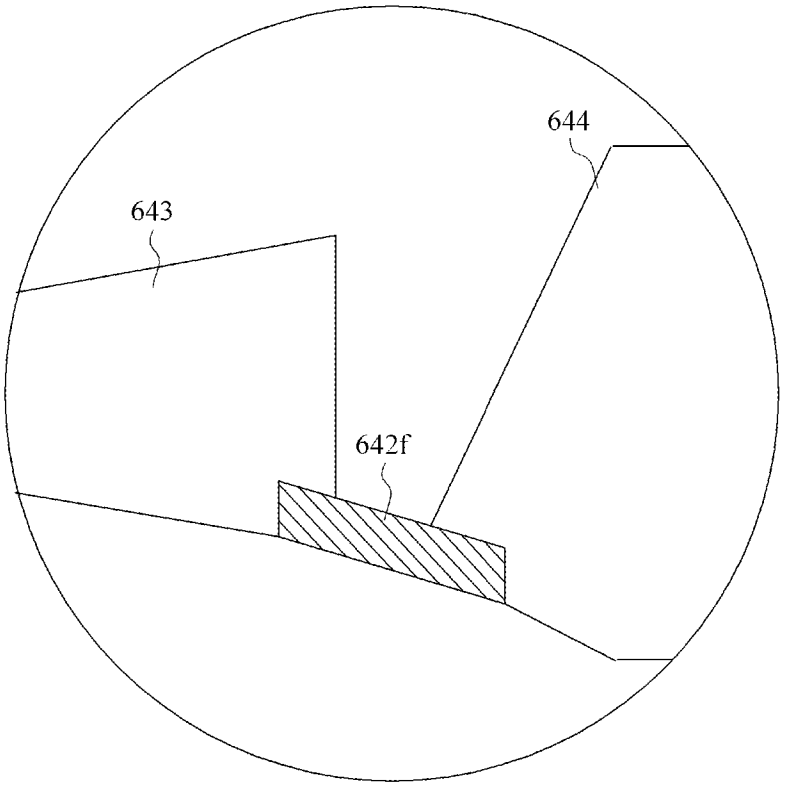

In the embodiment shown in FIG. 6F, a radial cross section of a connecting ring 642*f* also presents a parallelogram, and a connecting position of the connecting ring 642*f* and the inner ring blade 643 is above a connecting position of the connecting ring 642*f* and the outer ring blade 644. However, unlike FIG. 6E in which the connecting ring 642*e* is connected to a middle position of the inner ring blade 643, the connecting ring 642*f* of this embodiment is connected to a lower edge of the inner ring blade 643.

Figure 6G:
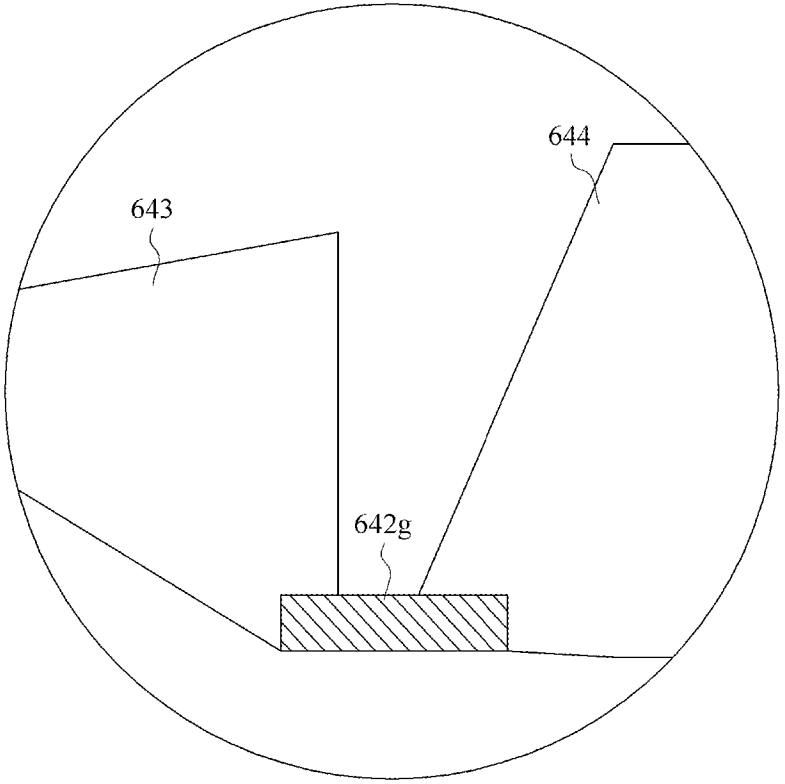

In the embodiment shown in FIG. 6G, a radial cross section of the connecting ring 642*g* presents a rectangle. However, unlike FIG. 4 in which the connecting ring 142 is connected to the middle position of the inner ring blade 143, the connecting ring 642*g* of this embodiment is connected to the lower edge of the inner ring blade 643.

The fan blade module 140 of the centrifugal fan 100 provided in this disclosure includes the inner ring blades 143, 543*a*, 543*b*, 543*c*, and 643, the connecting rings 142, 542, 642*a*, 642*b*, 642*c*, 642*d*, 642*e*, 642*f*, and 642*g*, and the outer ring blades 144 and 644. The outer ring blades 144 and 644 extend outward from the connecting ring 142, and diameters of the connecting rings 142, 542, 642*a*, 642*b*, 642*c*, 642*d*, 642*e*, 642*f*, and 642*g* are greater than a diameter of the hub. Therefore, under the limitation of the same manufacturing capability, more blades are arranged in the centrifugal fan 100 provided in this disclosure than the conventional centrifugal fan 100, to improve fan performance. In addition, the inner ring blades 143, 543*a*, 543*b*, 543*c*, and 643 located inside the connecting rings 142, 542, 642*a*, 642*b*, 642*c*, 642*d*, 642*e*, 642*f*, and 642*g* also have a capability of guiding the airflows to the outer ring blades 144 and 644, which is beneficial to improving the fan performance.

The foregoing descriptions are merely preferred embodiments of this disclosure, and do not constitute any limitation on this disclosure. Any form of variation such as equivalent replacement or modification made to the technical means and technical content disclosed in this disclosure without departing from the scope of the technical means of this disclosure is the content of the technical means of this disclosure and still falls within the protection scope of this disclosure.

What is claimed is:

1. A centrifugal fan, comprising:

a lower cover;

an upper cover;

a fan frame, located between the lower cover and the upper cover, wherein the fan frame, the lower cover, and the upper cover form a space; and a fan blade module, located in the space and comprising:

a hub;

a connecting ring, surrounding the hub and forming an inner ring region and an outer ring region around the hub, wherein the connecting ring comprises a ring height and a ring width, and the ring width is greater than the ring height;

a plurality of inner ring blades, connected to the hub and the connecting ring, and arranged circularly in the inner ring region; and a plurality of outer ring blades, connected to the connecting ring, and circularly arranged in the outer ring region, wherein a quantity of the outer ring blades is greater than a quantity of the inner ring blades, wherein the connecting ring has an inside radius and an outside radius, a surrounding range of the inner ring blades defines an inner circle, and the inner circle has an inner circle radius, a surrounding range of the outer ring blades defines an outer circle, the outer circle has an outer circle radius, the inner circle radius is greater than the inside radius, and the inner circle radius is less than the outside radius.

2. The centrifugal fan according to claim 1, wherein the outside radius is less than or equal to 85% of the outer circle radius.

3. The centrifugal fan according to claim 1, wherein the inside radius is greater than or equal to 60% of the outside radius.

4. The centrifugal fan according to claim 1, wherein the outer circle radius is greater than the outside radius.

5. The centrifugal fan according to claim 1, wherein a blade height of the inner ring blade is three times greater than a blade thickness of the inner ring blade.

6. The centrifugal fan according to claim 1, wherein the inner ring blade is located within a range formed by a lower surface of the lower cover and an upper surface of the upper cover.

7. The centrifugal fan according to claim 1, wherein the upper cover comprises an upper air inlet, the lower cover comprises a lower air inlet, the upper air inlet has an upper air inlet radius, and the lower air inlet has a lower air inlet radius, and the outside radius is less than the upper air inlet radius or the lower air inlet radius.

8. The centrifugal fan according to claim 1, wherein a radial cross section of the connecting ring presents a rectangle, a trapezoid, or a drop shape.

9. The centrifugal fan according to claim 1, wherein the connecting ring has an inside ring height and an outside ring height, and the inside ring height is less than the outside ring height.

* * * * *